US009227751B2

(12) United States Patent
Scrimger

(10) Patent No.: US 9,227,751 B2
(45) Date of Patent: Jan. 5, 2016

(54) DIVIDABLE TRAY

(75) Inventor: Michael Todd Scrimger, Coopersville, MI (US)

(73) Assignee: Nestec S.A., Vevey (CH)

( * ) Notice: Subject to any disclaimer, the term of this patent is extended or adjusted under 35 U.S.C. 154(b) by 123 days.

(21) Appl. No.: 13/985,308

(22) PCT Filed: Feb. 10, 2012

(86) PCT No.: PCT/US2012/024628

§ 371 (c)(1), (2), (4) Date: Nov. 8, 2013

(87) PCT Pub. No.: WO2012/112387

PCT Pub. Date: Aug. 23, 2012

(65) Prior Publication Data

US 2014/0054360 A1 Feb. 27, 2014

Related U.S. Application Data

(60) Provisional application No. 61/444,420, filed on Feb. 18, 2011, provisional application No. 61/479,014, filed on Apr. 26, 2011.

(51) Int. Cl.

| | |
|---|---|
| ***B65D 5/4805*** | (2006.01) |
| ***B65D 5/52*** | (2006.01) |
| ***B65D 5/54*** | (2006.01) |
| ***B65D 5/20*** | (2006.01) |
| ***B65D 5/68*** | (2006.01) |

(52) U.S. Cl.

CPC ..... *B65D 5/20* (2013.01); *B65D 5/48022* (2013.01); *B65D 5/52* (2013.01); *B65D 5/5253* (2013.01); *B65D 5/5475* (2013.01); *B65D 5/5495* (2013.01); *B65D 5/68* (2013.01); *B65D 2203/00* (2013.01)

(58) Field of Classification Search

CPC .... B65D 5/5475; B65D 5/52; B65D 5/48022; B65D 5/5253; B65D 5/5495

USPC ..... 229/120.011, 120.17; 206/736, 746

See application file for complete search history.

(56) References Cited

U.S. PATENT DOCUMENTS

| | | | | |
|---|---|---|---|---|
| 2,706,075 | A * | 4/1955 | Buttery | 229/120.16 |
| 2,718,997 | A * | 9/1955 | Shuxteau | 229/117.13 |
| 5,855,315 | A * | 1/1999 | Roseth | 229/120.04 |

(Continued)

FOREIGN PATENT DOCUMENTS

| | | | | |
|---|---|---|---|---|
| DE | 29503684 U1 * | 6/1995 | | B65D 5/5253 |
| DE | 29602010 U1 * | 5/1996 | | B65D 5/52 |
| GB | 2209152 | 5/1989 | | |

OTHER PUBLICATIONS

International Search Report and Written Opinion dated Apr. 19, 2012, received in PCT Application No. PCT/US2012/024628.

*Primary Examiner* — Gary Elkins

(74) *Attorney, Agent, or Firm* — Gary M. Lobel

(57) ABSTRACT

Packages for housing consumable products or secondary containers having consumable products and methods of making and using same are provided. In a general embodiment, the present disclosure provides a tray having first and second opposing side walls, a front wall, a back wall, a bottom wall, and an interior wall that divides the tray into at least two separate compartments. The interior wall may include first and second adjacent panels joined by one of a perforation and a score. The perforation and/or score will allow the tray to be configured, at least, as one tray having two separate compartments, or as two separate and discrete trays.

17 Claims, 10 Drawing Sheets

(56) References Cited

U.S. PATENT DOCUMENTS 5,979,747 A * 11/1999 Gnadt et al. ..... 229/120.17
6,676,012 B1 1/2004 Southwell et al.
6,789,726 B2 * 9/2004 Keefe et al. ..... 229/120.011
2011/0259947 A1 * 10/2011 Brittain ..... 229/120.011

* cited by examiner

DIVIDABLE TRAY

BACKGROUND

The present disclosure relates generally to packaging. More specifically, the present disclosure relates to trays for storing and displaying products and/or secondary containers having consumable products. Several aspects of storing and displaying products and/or secondary containers having consumable products may be discussed in the present disclosure including, but not limited to, protecting the products from being damaged during shipping, storing or handling, and providing several different configurations of the same package for retail display.

Packaging for consumable products come in a variety of sizes, shapes, materials and designs. These sizes, shapes, materials and designs generally differ, for example, for aesthetic reasons or marketing purposes. Consumable product packaging having certain functional features, however, can provide advantages to a user of such packages in addition to possible aesthetic and marketing advantages.

SUMMARY

Packages for storing and displaying products and/or secondary containers having products are provided. In a general embodiment, the present disclosure provides packages or trays that are formed from package blanks having first and second outer sections, first and second middle sections, and first and second inner sections joined by one of a perforation and a score. The first middle section is located between the first outer section and the first inner section, and the second middle section is located between the second outer section and the second inner section. The blank is substantially flat.

In an embodiment, the first and second inner sections are joined by a perforation that is a ⅛ inch by ⅛ inch perforation.

In an embodiment, the first and second outer sections and the first and second middle sections, respectively, are joined by one of a score and a perforation. The first and second middle sections and the first and second inner sections, respectively, may also be joined by one of a score and a perforation.

In an embodiment, the outer sections, inner sections and middle sections may each have first and second end sections. The first and second end sections may each include a panel. The outer sections, inner sections and middle sections may be joined to their respective end panels by one of a score and a perforation. The end panels of the first and second middle sections may be substantially as wide as the first and second middle sections.

In an embodiment, the end panels of the first and second outer sections are located substantially adjacent to the end panels of the first and second middle sections. The end panels of the first and second inner sections may also be located substantially adjacent to each other. The end panels of the first and second inner sections may be the same length, or the end panels of the first inner section may be shorter than the end panels of the second inner section. The end panels of the first inner section may be shorter than the end panels of the second inner section by a length that is from about ⅛ inches to about ½ inches, or about ¼ inches.

In an embodiment, the outer sections, inner sections, and middle sections have a length from about 5 inches to about 15 inches, or about 10 inches.

In an embodiment, the end panels of the first and second outer sections, and first and second middle sections have a length from about 13/16 inches to about 2 and 7/16 inches, or about 3 and ¼ inches.

In an embodiment, the outer sections have a width from about 1 and 13/16 inches to about 5 and 7/16 inches, or about 3 and ⅝ inches.

In an embodiment, the inner sections have a width from about ¾ inches to about 2 and ¼ inches, or about 1.5 inches.

In an embodiment, the middle sections have a width from about 1 and 23/32 inches to about 5 and 5/32 inches, or about 3 and 7/16 inches.

In an embodiment, the blank has a length from about 6 and ⅝ inches to about 19 and ⅞ inches, or about 13 and ¼ inches.

In an embodiment, the blank has a width from about 8 and 9/16 inches to about 26 and ⅝ inches, or about 17 and ⅛ inches.

In another embodiment, a tray is provided. The tray includes first and second opposing side walls, a front wall including a plurality of panels, a back wall including a plurality of panels, and a bottom wall having one of a perforation and a score that is configured to separate the tray into two individual sections.

In an embodiment, the one of a perforation and a score is a perforation that is substantially parallel to the first and second opposing side walls.

In an embodiment, the two individual sections have the same dimensions. In this manner, the two individual sections may be mirror images of each other when separated.

In an embodiment, the plurality of panels on the front wall have different lengths. The plurality of panels on the front wall may also have different widths.

In an embodiment, the plurality of panels on the back wall have different lengths. The plurality of panels on the back wall may also have different widths.

In an embodiment, the tray is formed from one piece of material. The material may be selected from the group consisting of plastic, cardboard, fiberboard, paperboard, jute, styrofoam, metals, or combinations thereof. In an embodiment, the material is corrugated cardboard.

In an embodiment, the first and second opposing side walls include at least one panel extending therefrom that is configured to attach to one of the front wall and the back wall.

In yet another embodiment, tray is provided. The tray includes a first compartment having an exterior side wall, an interior side wall, a front wall, a back wall, and a bottom wall, and a second compartment having an exterior side wall, an interior side wall, a front wall, a back wall, and a bottom wall. The interior wall of the first compartment and the interior wall of the second compartment are joined by one of a perforation and a score.

In an embodiment, the one of a perforation and a score is a perforation that is configured to allow the first and second compartments to be separated.

In an embodiment, the front walls of the first and second compartments and the back walls of the first and second compartments each include a single panel. The single panel of the first compartment may be an extension of the bottom wall of the first compartment, and the single panel of the second compartment may be an extension of the bottom wall of the second compartment.

In an embodiment, the front and back walls of the first compartment further include an attached panel extending from the exterior side wall of the first compartment. The attached panel may also be a panel extending from the exterior side wall of the second compartment. The attached panel may also be a panel extending from the interior side wall of the first compartment. The attached panel may further be a panel extending from the interior side wall of the second compartment.

In an embodiment, the interior wall of the first compartment and the interior wall of the second compartment are adjacent and substantially overlap each other.

In an embodiment, the exterior side walls of the first and second compartments are taller than the interior side walls of the first and second compartments.

In still yet another embodiment, a tray is provided. The tray includes a chamber defined by first and second opposing side walls, a front wall, a back wall, and a bottom wall. A portion of the bottom wall is folded into the chamber to form at least two compartments of the tray.

In an embodiment, the portion of the bottom wall that is folded into the chamber is oriented substantially vertically. A top of the portion of the bottom wall that is folded into the chamber may include one of a perforation and a score that is configured to allow the at least two compartments to be separated. In an embodiment, the portion of the bottom wall that is folded into the chamber includes two adjacent layers of the bottom wall that substantially overlap each other. The portion of the bottom wall that is not folded into the chamber may form a substantially flat surface that is substantially perpendicular to the portion of the bottom wall that is folded into the chamber.

In an embodiment, the front wall is formed from at least two panels, each panel extending from the bottom wall. The at least two panels may be oriented end-to-end and are located substantially adjacent to each other to form the front wall. The front wall may further include a panel selected from the group consisting of a panel extending from the first side wall, a panel extending from the second side wall, a panel extending from the portion of the bottom wall that is folded into the chamber, or combinations thereof.

In an embodiment, the back wall includes at least two panels, each panel extending from the bottom wall. The at least two panels may be oriented end-to-end and are located substantially adjacent to each other to form the back wall. The back wall may further include a panel selected from the group consisting of a panel extending from the first side wall, a panel extending from the second side wall, a panel extending from the portion of the bottom wall that is folded into the chamber, or combinations thereof.

In an embodiment, the first and second opposing walls are taller than the portion of the bottom wall that is folded into the chamber.

In another embodiment, a tray is provided. The tray includes first and second opposing side walls, a front wall, a back wall, a bottom wall, and an interior wall that divides the tray into at least two separate compartments. The interior wall includes first and second adjacent panels joined by one of a perforation and a score.

In an embodiment, the adjacent panels are joined by a perforation at a top of the adjacent panels.

In an embodiment, the interior wall is formed from a portion of the bottom wall.

In an embodiment, the front wall includes at least two panels, each panel extending from the bottom wall. The at least two panels are oriented end-to-end and located substantially adjacent to each other to form the front wall. The front wall may further include a panel selected from the group consisting of a panel extending from the first side wall, a panel extending from the second side wall, a panel extending from the portion of the bottom wall that is folded into the chamber, or combinations thereof.

In an embodiment, the back wall includes at least two panels, each panel extending from the bottom wall. The at least two panels may be oriented end-to-end and located substantially adjacent to each other to form the back wall. The back wall may further include a panel selected from the group consisting of a panel extending from the first side wall, a panel extending from the second side wall, a panel extending from the portion of the bottom wall that is folded into the chamber, or combinations thereof.

In an embodiment, the first and second opposing side walls are taller than the interior wall.

In yet another embodiment, a tray is provided. The tray includes a chamber defined by first and second opposing side walls, a front wall, a back wall, and a bottom wall including one of a perforation and a score. The one of a perforation and a score that is configured to (i) allow the bottom wall to lay flat in a first embodiment, and (ii) allow a portion of the bottom wall to be folded into the chamber to form at least two compartments in a second embodiment.

In an embodiment, the front wall includes at least two panels in both the first and second embodiments. The panels may extend from the bottom wall. The front wall may further include a panel extending from at least one of first and second opposing side walls, the panel attached to the panel extending from the bottom wall.

In an embodiment, the back wall includes at least two panels in both the first and second embodiments. The panels may extend from the bottom wall. The back wall may further include a panel extending from at least one of first and second opposing side walls, the panel attached to the panel extending from the bottom wall.

In an embodiment, the first and second opposing side walls are taller than portion of the bottom wall that is folded into the chamber in the second embodiment.

In an embodiment, the at least two components are mirror images of each other along the one of a perforation and a score.

In still yet another embodiment, a tray is provided. The tray includes a chamber defined by first and second opposing side walls, a front wall, a back wall, and a bottom wall including one of a perforation and a score. The one of a perforation and a score that is configured to (i) allow the bottom wall to lay flat in a first embodiment, and (ii) allow the tray to be separated into at least two components in a second embodiment.

In an embodiment, the front wall includes at least two panels in the first embodiment. The panels may extend from the bottom wall. The front wall may further include a panel extending from at least one of first and second opposing side walls, the panel attached to the panel extending from the bottom wall.

In an embodiment, the back wall includes at least two panels in the first embodiment. The panels may extend from the bottom wall. The back wall may further include a panel extending from at least one of first and second opposing side walls, the panel attached to the panel extending from the bottom wall.

In an embodiment, the at least two components are mirror images of each other when separated.

In another embodiment, a method for making a tray is provided. The method includes providing a blank having first and second outer sections, first and second inner sections joined by one of a perforation and a score, and first and second middle sections. The first middle section is located between the first outer section and the first inner section, and the second middle section is located between the second outer section and the second inner section. The method further includes folding the blank along the one of a perforation and score, folding the blank along lines dividing the first and second middle sections from the first and second inner sections, respectively, and folding the blank along lines dividing the first and second middle sections from the first and second outer sections, respectively, to form a tray.

In an embodiment, the blank further includes first and second ends, each of the first and second ends having a plurality of panels.

In an embodiment, the method further includes folding the plurality of panels of the first end to form a front wall, and/or folding the plurality of panels of the second end to form a back wall.

In an embodiment, the plurality of panels of the first end are adhered to each other to form the front wall. Additionally, the plurality of panels of the second end may be adhered to each other to form the back wall.

In an embodiment, the method further includes placing secondary packages onto the blank after folding the blank along lines dividing the first and second middle sections from the first and second inner sections, respectively.

In an embodiment, the method further includes placing consumable products into the tray after folding the blank along lines dividing the first and second middle sections from the first and second outer sections, respectively.

In an embodiment, the method further includes placing a shroud over the tray.

In yet another embodiment, a method for displaying a consumable product is provided. The method includes providing a tray housing a consumable product, the tray having first and second opposing side walls, a front wall with a plurality of panels, a back wall with a plurality of panels, and a bottom wall comprising one of a perforation and a score that is configured to separate the tray into two individual sections. The method further includes placing the tray on a retail shelf.

In an embodiment, the consumable product is contained in a secondary package.

In an embodiment, the method further includes removing a shroud from the tray before placing the tray on the retail shelf.

In still yet another embodiment, a method for displaying a consumable product is provided. The method includes providing a tray housing a consumable product, the tray having first and second opposing side walls, a front wall comprising a plurality of panels, a back wall comprising a plurality of panels, and a bottom wall including one of a perforation and a score that is configured to separate the tray into two individual sections. The method further includes tearing the tray along the one of a perforation and a score to separate the tray into the two individual sections, and placing at least one of the two individual sections on a retail shelf.

In an embodiment, the method further includes removing a shroud from the tray before tearing the tray.

In an embodiment, the method further includes stacking a first of the two individual sections on top of a second of the two individual sections before placing the first and second individual sections on the retail shelf.

In another embodiment, a method for displaying a consumable product is provided. The method includes providing a tray housing a consumable product, the tray having a first compartment having an exterior side wall, an interior side wall, a front wall, a back wall, and a bottom wall, and a second compartment having an exterior side wall, an interior side wall, a front wall, a back wall, and a bottom wall. The interior wall of the first compartment and the interior wall of the second compartment are joined by one of a perforation and a score. The method further includes placing the tray on a retail shelf.

In an embodiment, the method further includes removing a shroud from the tray before placing the tray on the retail shelf.

In yet another embodiment, a method for displaying a consumable product is provided. The method includes providing a tray housing a consumable product, the tray having a first compartment having an exterior side wall, an interior side wall, a front wall, a back wall, and a bottom wall, and a second compartment having an exterior side wall, an interior side wall, a front wall, a back wall, and a bottom wall. The interior wall of the first compartment and the interior wall of the second compartment are joined by one of a perforation and a score. The method further includes tearing the tray along the one of a perforation and a score to separate the first and second compartments, and placing at least one of the first and second compartments on a retail shelf.

In an embodiment, the method further includes removing a shroud from the tray before tearing the tray.

In an embodiment, the method further includes stacking the first compartment on top of the second compartment before placing the first and second compartments on the retail shelf.

In still yet anther embodiment, a method for displaying a consumable product is provided. The method includes providing a tray housing a consumable product, the tray having a chamber defined by first and second opposing side walls, a front wall, a back wall, and a bottom wall. A portion of the bottom wall is folded into the chamber to form at least two compartments of the tray. The method further includes placing the tray on a retail shelf.

In an embodiment, the method further includes removing a shroud from the tray before placing the tray on the retail shelf.

In another embodiment, a method for displaying a consumable product is provided. The method includes providing a tray housing a consumable product, the tray having a chamber defined by first and second opposing side walls, a front wall, a back wall, and a bottom wall. A portion of the bottom wall is folded into the chamber to form at least two compartments of the tray. The method further includes separating the at least two compartments of the tray, and placing at least one of the at least two compartments on a retail shelf.

In an embodiment, the method further includes removing a shroud from the tray before separating the at least two compartments of the tray.

In an embodiment, the method further includes stacking a first of the at least two compartments on top of a second of the at least two compartments before placing the compartments on the retail shelf.

In another embodiment, a method for displaying a consumable product is provided. The method includes providing a tray housing a consumable product, the tray including first and second opposing side walls, a front wall, a back wall, a bottom wall, and an interior wall that divides the tray into at least two separate compartments. The interior wall includes first and second adjacent panels joined by one of a perforation and a score. The method further includes placing the tray on a retail shelf.

In an embodiment, the method further includes removing a shroud from the tray before placing the tray on the retail shelf.

In yet another embodiment, a method for displaying a consumable product is provided. The method includes providing a tray housing a consumable product, the tray having first and second opposing side walls, a front wall, a back wall, a bottom wall, and an interior wall that divides the tray into at least two separate compartments. The interior wall includes first and second adjacent panels joined by one of a perforation and a score. The method further includes tearing the tray along the one of a perforation and a score to separate the tray into the at least two separate compartments, and placing at least one of the at least two compartments on a retail shelf.

In an embodiment, the method further includes removing a shroud from the tray before tearing the tray.

In an embodiment, the method further includes stacking a first of the at least two separate compartments on top of a second of the at least two separate compartments before placing the compartments on the retail shelf.

It is an advantage of the present disclosure to provide improved packages.

It is another advantage of the present disclosure to provide packages that are capable of being configured in more than one arrangement.

Yet another advantage of the present disclosure is to provide packages that are configured to be split into two compartments.

Still yet another advantage of the present disclosure is to provide packages that are configured to house consumable products and/or secondary packages containing consumable products.

It is also an advantage of the present disclosure to provide packages that are aesthetically pleasing.

It is a further advantage of the present disclosure to provide packages that are easy to display on a retail shelf.

It is yet another advantage of the present disclosure to provide improved methods for making a package.

It is another advantage to provide improved methods for displaying packages on a retail shelf.

Additional features and advantages are described herein, and will be apparent from the following Detailed Description and the figures.

DETAILED DESCRIPTION

Figure 1:
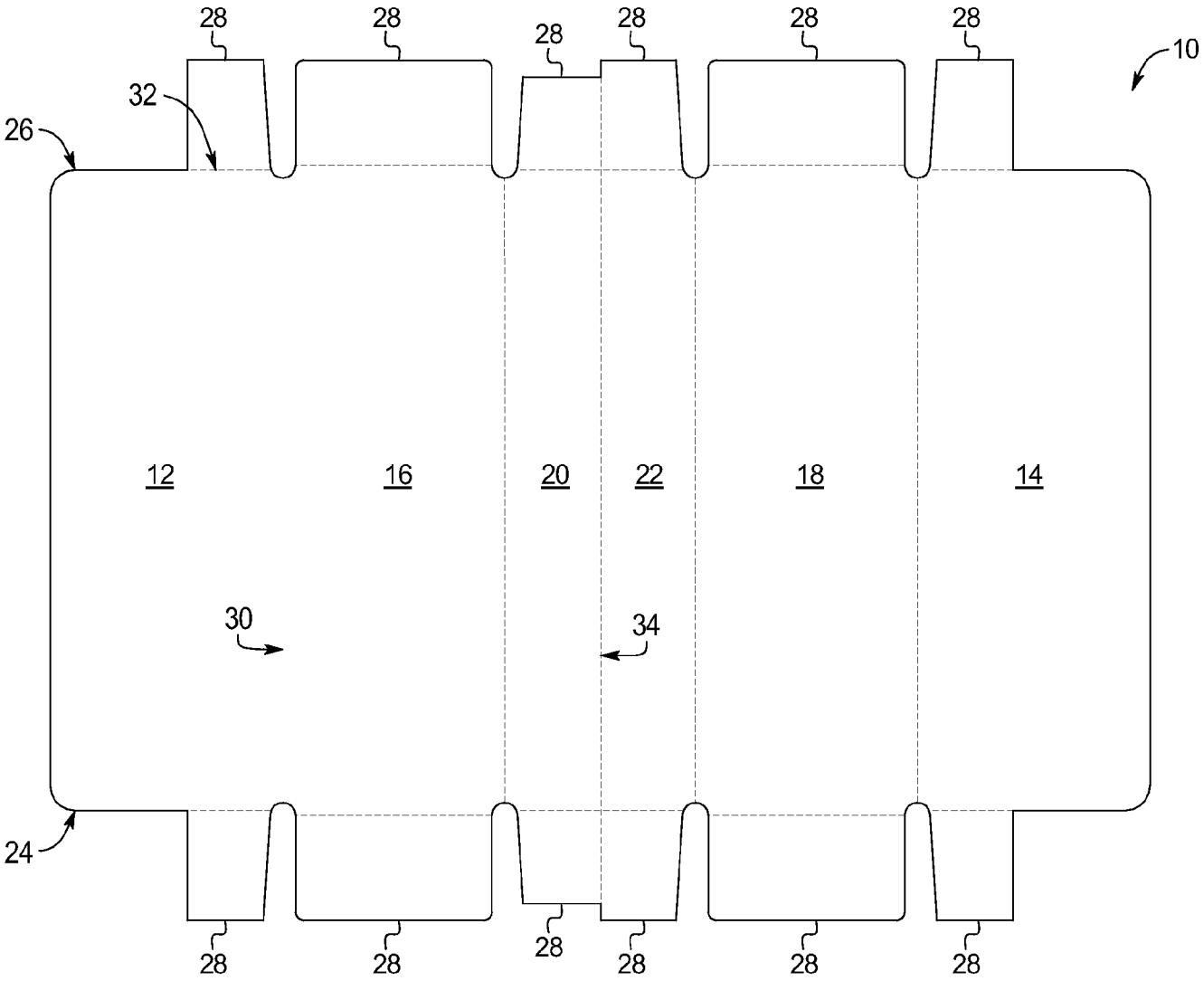
FIG. 1 illustrates a top view of a packaging blank in accordance with an embodiment of the present disclosure.

As used in this disclosure and the appended claims, the singular forms "a," "an" and "the" include plural referents unless the context clearly dictates otherwise. Thus, for example, reference to "a panel" includes a single panel, two or more panels, and the like.

As used herein, "about" is understood to refer to numbers in a range of numerals. Moreover, all numerical ranges herein should be understood to include all integer, whole or fractions, within the range.

"Nutritional products," or "nutritional compositions," as used herein, are understood to include any number of optional additional ingredients, including conventional food additives (synthetic or natural), for example one or more acidulants, additional thickeners, buffers or agents for pH adjustment, chelating agents, colorants, emulsifies, excipient, flavor agent, mineral, osmotic agents, a pharmaceutically acceptable carrier, preservatives, stabilizers, sugar, sweeteners, texturizers, and/or vitamins. The optional ingredients can be added in any suitable amount. The nutritional products or compositions may be a source of complete nutrition or may be a source of incomplete nutrition.

As used herein, a "perforation" is a series of cuts or holes in a material that are organized in either a repeating or a random pattern. The perforations of the present disclosure are typically linear perforations, but the skilled artisan will appreciate that any shape or size perforation may be used in the present disclosure. Perforations are usually used to allow easy separation of two sections of a material, such as allowing paper to be torn easily along a perforation line. Packages with perforations in paperboard or plastic film are easier for consumers to open and allows for different presentations of the product contained within the packaging. Other purposes for using perforations include, for example, filtrating fluids, sound deadening, allowing light or fluids to pass through, and creating aesthetic designs.

The present disclosure is generally related to packaging. More specifically, the present disclosure is related to trays used to house consumable products or secondary packages containing consumer products (e.g., nutritional compositions). The trays of the present disclosure include an open chamber having four walls and a bottom, and one of a perforation and a score that allows the tray to be configured as one, open tray in a first embodiment, or as one tray with two compartments in a second embodiment. The tray may be torn along the perforation or score to allow the tray to be separated into two, discrete sections in yet another embodiment. The two, discrete sections may have the same dimensions (e.g., mirror images of each other), or may have different dimensions. In other words, when the trays are separated into two, discrete sections, the sections may be of equal size or unequal size.

The trays of the present disclosure may be used for many purposes including, but not limited to, shipping, storing, and displaying retail products. With respect to shipping, the tray may be shipped by itself, or inside a larger box, or with a lid or shroud placed over the top of the open chamber. The lid or should may be formed from the same material as the tray and may be adhered to the tray, or may simply include a shrink-wrap or plastic cover that encases the tray. Regarding display, the trays of the present disclosure may provide a retailer with several different ways in which to display the products contained in the tray. As mentioned above, the tray may be one, open tray containing a plurality of products, or may be divided into at least two compartments, or may be physically separated by the perforation and/or score. In this manner, there are several configurations in which a retailer may place the trays on a retail shelf for display. The trays of the present disclosure may also be displayed in a variety of different environments including, for example, on a store shelf, in a refrigerator, in a freezer, etc.

The trays may house, for example, consumable products or secondary containers. In an embodiment, the trays house consumable products. The consumable products may be a solid, liquid, semi-liquid, or combinations thereof. For example, the consumable products may be any consumable products including, for example, baby foods, snack foods, full meals, side meals, confectioneries, medicaments, gum, mints, etc. The tray can hold different colors of the same or different consumable product. Differently flavored, coated or textured products can also be stored therein. The consumable products may be individually wrapped or wrapped in bulk. However, if the trays are formed from sterile plastic materials, it is not necessary that the products be wrapped. In an embodiment, the packages house foods for children (e.g., infants, toddlers, pre-schoolers, etc.) including, for example, baby foods, fruits, vegetables, grains, cereals, pastas, etc. The consumable products may be finger foods or may be designed to be consumed using utensils. The teachings of the present disclosure, however, are not dependent upon the consumable products being of any particular type so long as the products fit within the trays described herein.

In an embodiment, the packages house secondary packages that may be designed to house consumable products. The secondary packages may include, but are not limited to, cans, bottles, pouches, boxes, cups, cartons, jars, trays, bags, etc. The consumable products housed in the secondary packages may be the same consumable products discussed above including, for example, solids, liquids, semi-liquids, or combinations thereof. For example, the secondary containers may contain foods for children (e.g., infants, toddlers, pre-schoolers, etc.) including, for example, baby foods, fruits, vegetables, grains, cereals, pastas, etc. The consumable products may be finger foods or may be designed to be consumed using utensils. The teachings of the present disclosure, however, are not dependent upon the consumable products being of any particular type so long as the products fit within the secondary containers described herein. While the present disclosure discusses the trays and secondary containers as housing consumable products, the skilled artisan will immediately appreciate that the packages of the present disclosure may house any product (e.g., non-edible products) so long as the product fits within the trays and/or secondary containers therein.

The trays of the present disclosure may have any shape or size known in the art. For example, the trays may be substantially cubic, rectangular, pyramidal, cylindrical, conical and spherical shapes, or combinations thereof. The trays are also not limited to a specific size, so long as the trays are able to house the products intended to be housed therein, and the trays are able to be torn apart by a consumer along a perforation and/or a score.

The packages may also be manufactured from any material that is able to be perforated and torn. For example, the packages may be manufactured from plastic, cardboard, fiberboard, paperboard, jute, styrofoam, metals, or combinations thereof. In an embodiment, the packages are manufactured from corrugated cardboard. In an embodiment wherein the material is, for example, plastic, consumable products may be housed in the trays without the need for secondary packaging.

FIG. 1 illustrates an example of a cut-out blank 10 that may be used to form a tray of the present disclosure. Blank 10 includes first and second outer sections 12, 14, respectively; first and second middle sections 16, 18, respectively; and first and second inner sections 20, 22, respectively. As is shown in FIG. 1, inner sections 20, 22 are in contact with each other and middle sections 16, 18; and outer sections 12, 14 are in contact with middle sections 16, 18. Blank 10 also includes first and second ends 24, 26, respectively, which each include a plurality of end panels 28. Although the present figures illustrate a plurality of end panels 28 on both first end 24 and second end 26, the skilled artisan will appreciate that blank 10 may include any number of end panels 28. For example, first end 24 may include from about 1 to about 10 end panels 28. In an embodiment, first end 24 includes 6 end panels, one on each of the outer, middle and inner sections.

First and second outer sections 12, 14, first and second inner sections 20, 22, and first and second middle sections 16, 18 may have a length from about 5 inches to about 15 inches, or about 10 inches. First and second outer sections 12, 14 may have a width from about 1 and 13/16 inches to about 5 and 7/16 inches, or about 3 and 5/8 inches. First and second inner sections 20, 22 may have a width from about 3/4 inches to about 2 and 1/4 inches, or about 1.5 inches. First and second middle sections 16, 18 may have a width from about 1 and 23/32 inches to about 5 and 5/32 inches, or about 3 and 7/16 inches.

End panels 28 of first inner section 20 may be shorter than the end panels 28 of second inner section 22 by a length that is from about 1/8 inches to about 1/2 inches, or about 1/4 inches. End panels 28 of first and second outer sections 12, 14, and first and second middle sections 16, 18 have a length from about 13/16 inches to about 2 and 7/16 inches, or about 3 and 1/4 inches. End panels 28 of first and second outer sections 12, 14 may be substantially adjacent to end panels 28 of first and second middle sections 16, 18. Similarly, end panels 28 of first and second inner sections 20, 22 may be adjacent each other, as shown in FIG. 1.

Blank 10 may have a total length from about 6 and 5/8 inches to about 19 and 7/8 inches, or about 13 and 1/4 inches. Blank 10 may also have a total width from about 8 and 9/16 inches to about 26 and 5/8 inches, or about 17 and 1/8 inches. Moreover, a skilled artisan will appreciate that the dimensions of the packages may vary as desired or in accordance with manufacturing specifications or in accordance with the size and shape of the consumable products or secondary containers to be housed therein.

Each of the sections of blank 10 may meet another section along an intended fold line, a perforation, a score, or combinations thereof. For example, first outer section 12 may meet first middle sections 16 along a perforated fold line 30. Similarly, each end panel 28 of blank 10 may meet its respective outer, middle or inner section along an intended fold line, a perforation, a score, or combinations thereof. For example, end panel 28 of first outer section 12 may meet first outer section 12 along a perforated fold line 32. A perforation or score 34 located between the two adjacent first and second inner sections 20, 22 allows the tray of the present disclosure to assume different configurations for shipping, storing, displaying, etc., as will be discussed further below.

Figure 2:
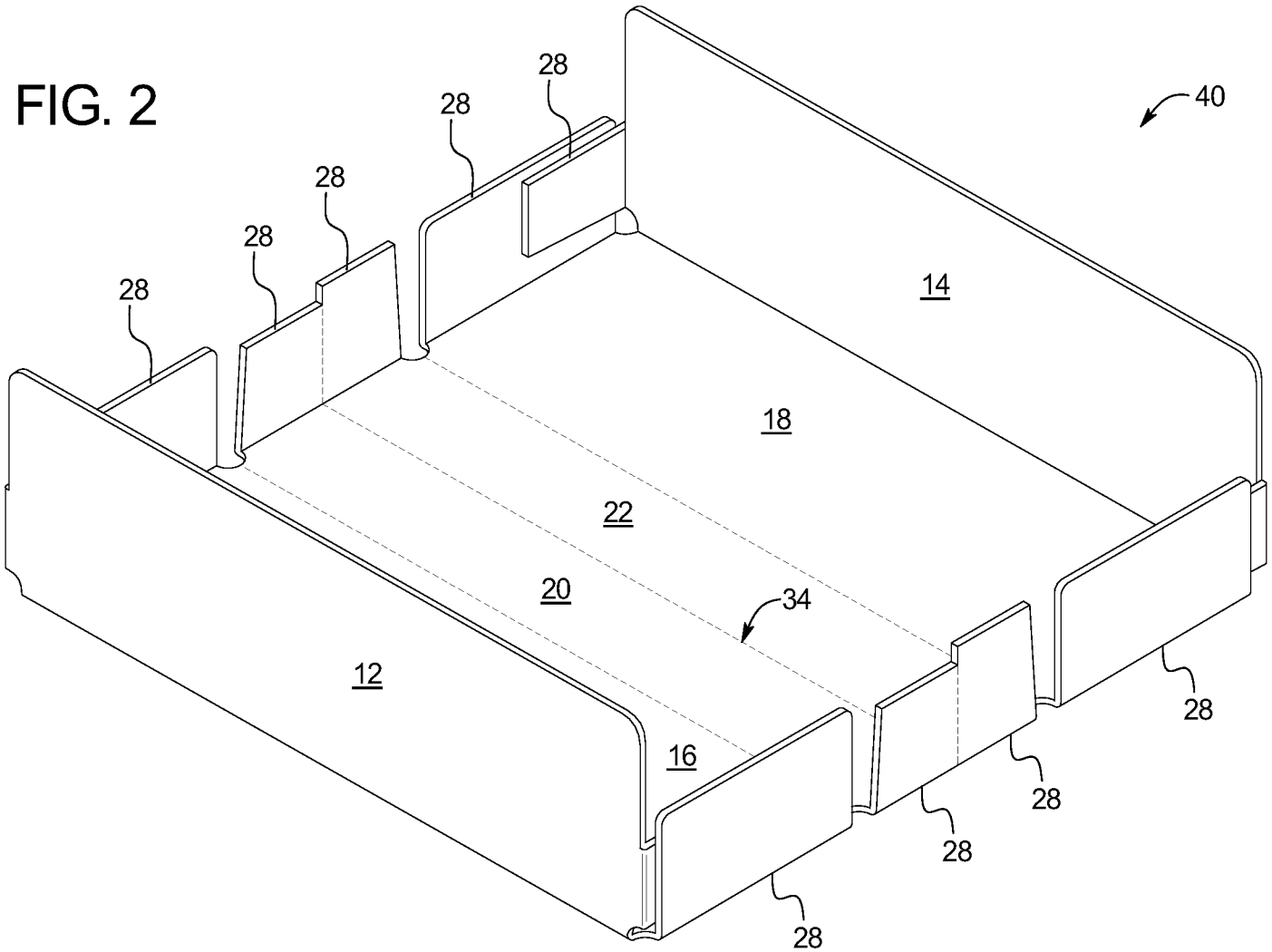
FIG. 2 illustrates a perspective view of a package in accordance with an embodiment of the present disclosure.

As mentioned briefly above, blank 10 may be folded into a few different embodiments depending on shipping, storage or display needs. For example, as shown in FIG. 2, blank 10 may be folded into tray 40 such that first and second outer sections 12, 14, and end panels 28 are substantially vertical, while middle sections 16, 18 and inner sections 20, 22 remain substantially horizontal. In this embodiment, middle sections 16, 18 and inner sections 20, 22 form a bottom wall of tray 40, which may house consumable products, as discussed above. As shown by FIG. 2, first and second outer sections 12, 14 form side walls of tray 40, and end panels 28 form a front wall at first end 24, and a back wall at second end 26. As shown by FIG. 2, end panels 28 of first and second outer walls 12, 14 are folded inside the chamber formed by side walls 12, 14, bottom wall 16, 18, 20, 22, and front and back walls 28. In this manner, end panels 28 of first and second outer walls 12, 14 folded inside the chamber may be attached to at least end panels 28 of middle sections 16, 18. End panels 28 of first and second outer walls 12, 14 may be attached to end panels 28 of middle sections 16, 18 by any known adhesive including, for example, tape, glue, chemical adhesives, fasteners, staples, etc.

Figure 8A:
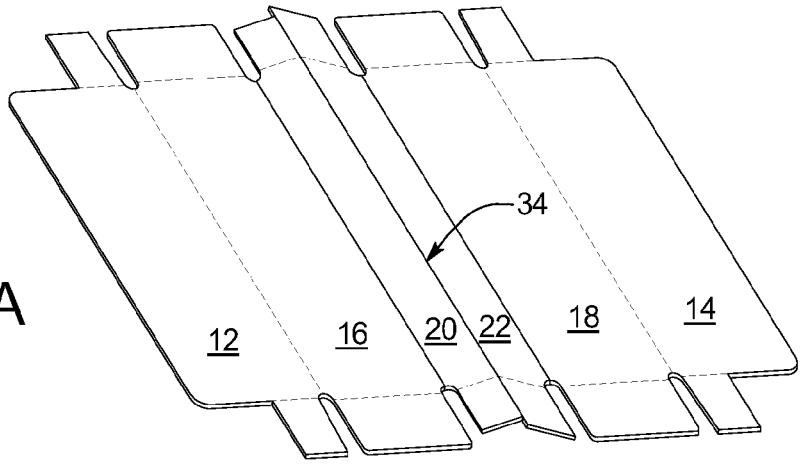
FIGS. 8A-8G illustrates a method for making a package in accordance with an embodiment of the present disclosure.
Figure 8B:
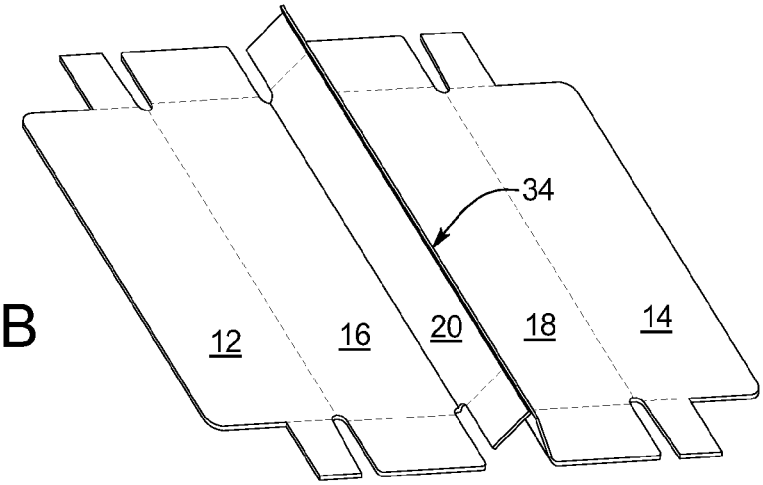
Figure 8C:
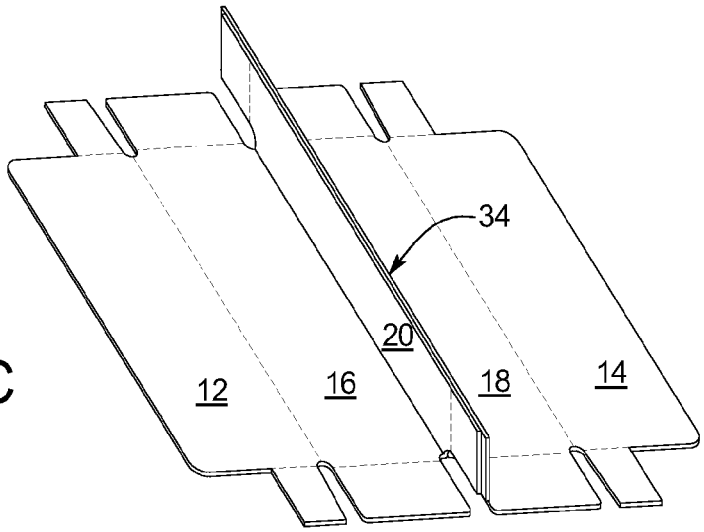
Figure 8D:
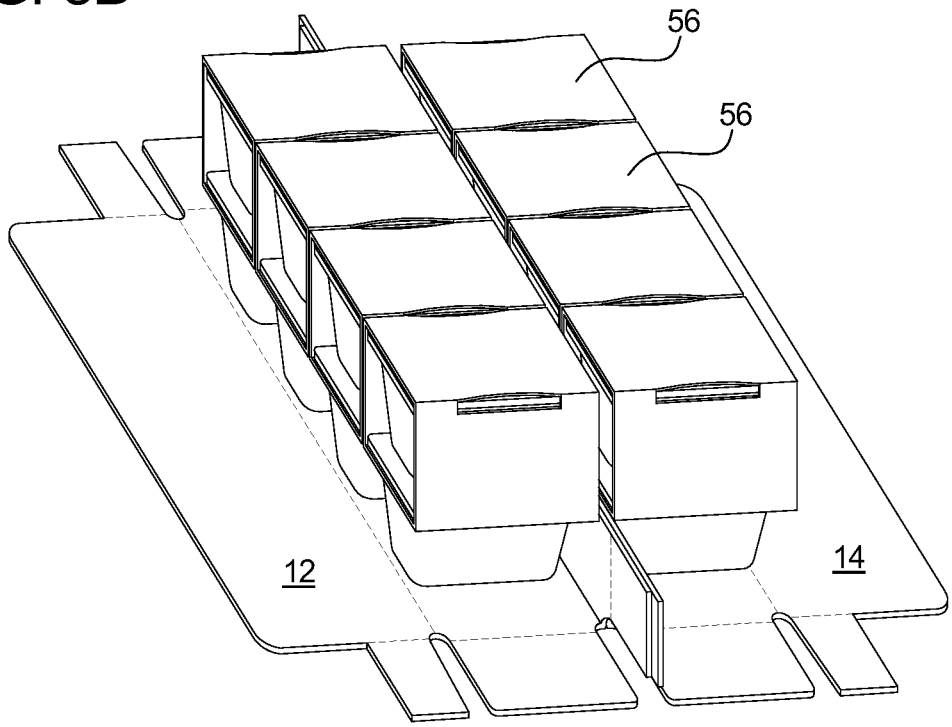
Figure 8E:
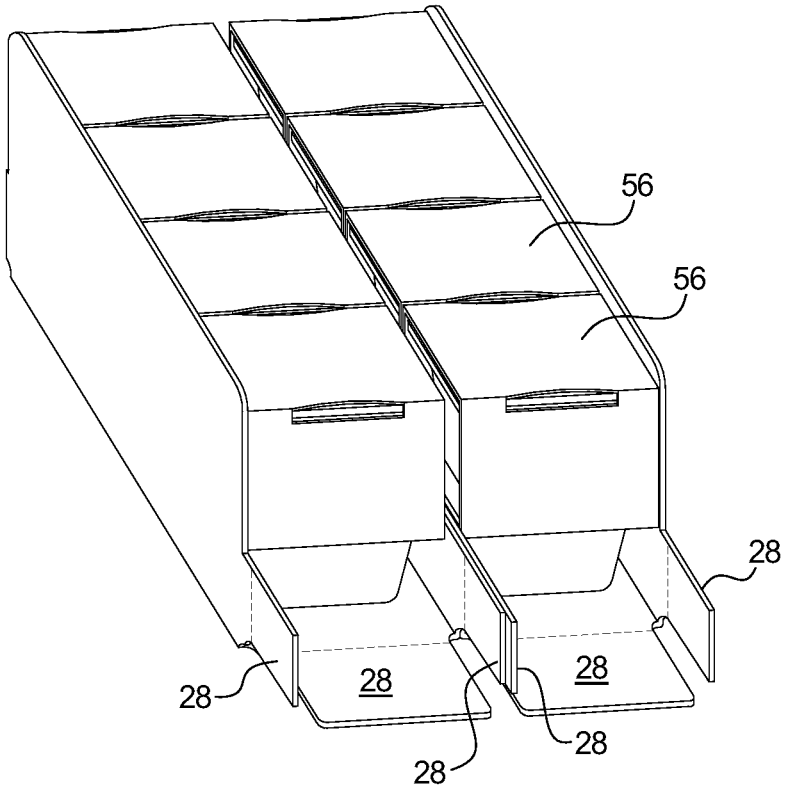
Figure 8F:
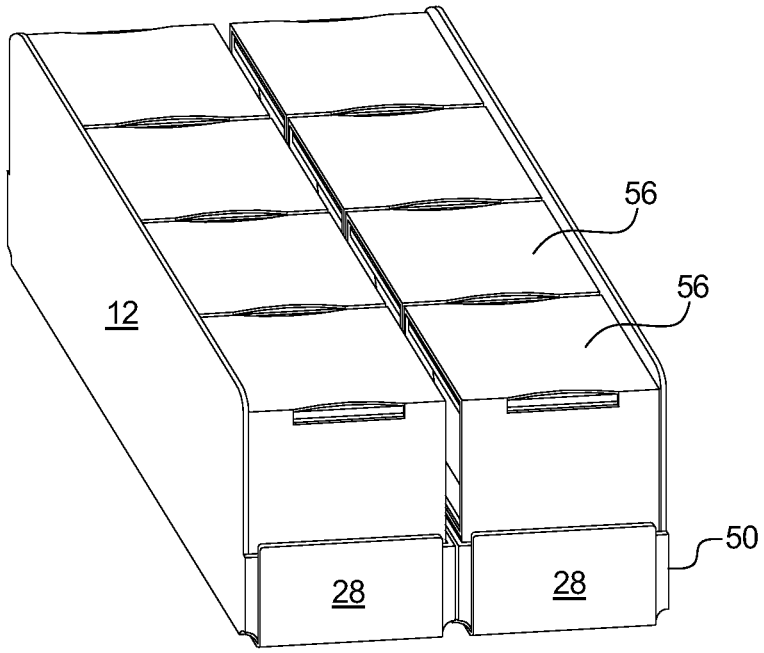
Figure 8G:
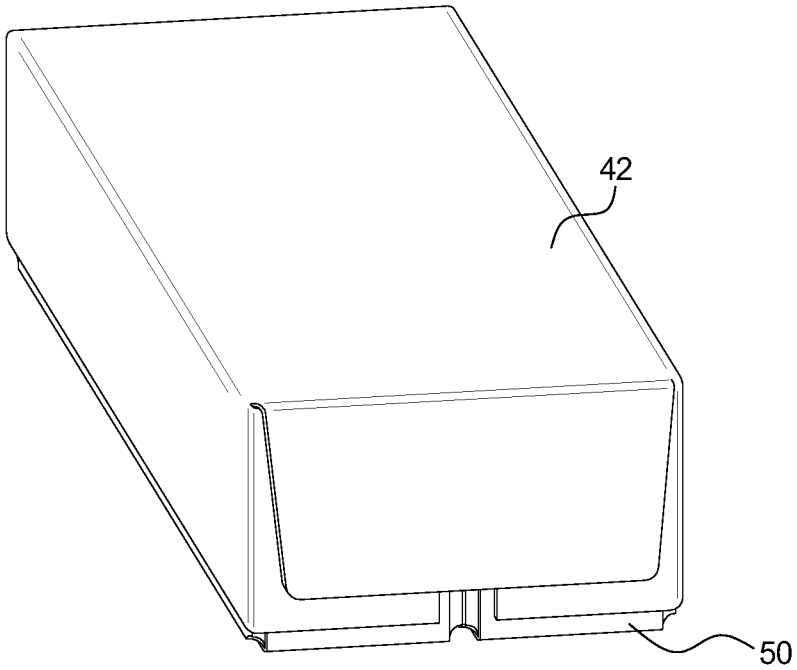

In the embodiment illustrated in FIG. 2, end panels 28 may remain in a vertical and upright position by placing a lid or a shroud 42 over tray 40, as is shown by FIG. 8G. The lid 42 may be any lid known in the art that is capable of closing the open chamber of tray 40. Lid 42 may be manufactured from the same materials as tray 40 (e.g., plastic, cardboard, fiberboard, paperboard, jute, styrofoam, metals, or combinations thereof), or may be a different material. For example, lid 42 may be a polymer cover that is glued, melted or other wise sealed to tray 40. In this manner, lid 42 may be a plastic wrap, cellophane or a shrink wrap. Lid 42 may further be a semi-hard or hard cover that snaps onto tray 40. Additionally, lid 42 may also be a shroud or a cover lid that sits on top of tray 40. The skilled artisan will appreciate that lid 42 of the present disclosure is not limited to the embodiment of tray 40 in FIG. 2, and may be used with any tray embodiment disclosed herein.

Figure 3:
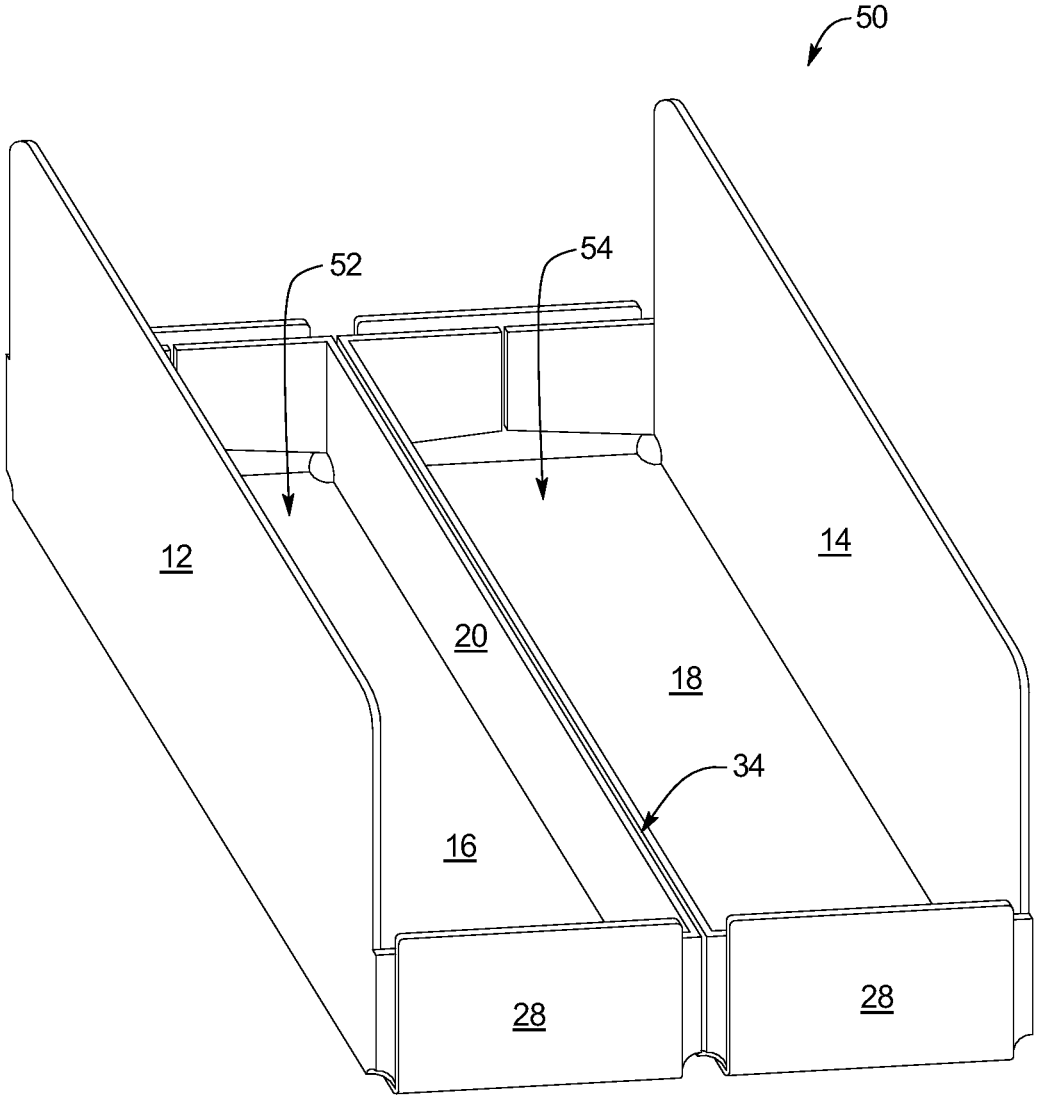
FIG. 3 illustrates a perspective view of a package in accordance with an embodiment of the present disclosure.

FIG. 3 illustrates another embodiment of the trays of the present disclosure. As shown in FIG. 3, tray 50 is another folded embodiment of blank 10. In contrast to FIG. 2, however, tray 50 of FIG. 3 is folded along perforation/score 34, and along the folds or lines where middle sections 16, 18 and inner sections 20, 22 meet. By folding blank 10 along perforation/score 34, tray 50 is formed and includes two, separate and distinct compartments 52, 54. A first compartment 52 is formed by first outer section 12, first middle section 16, first inner section 20, and their respective end panels 28. A second compartment 54 is formed by second outer section 14, second middle section 18, second inner section 22, and their respective end panels 28.

Although illustrated as having two separate compartments, the skilled artisan will appreciate that blank 10 may include any number of perforations/scores similar to perforation line 34 such that when blank 10 is folded into a tray, any number of separate and distinct compartments may form. Also, the scores or perforations can be of any size or shape suitable to allow the material of the trays to fold and/or tear. For example, in an embodiment wherein a tray is intended to be torn to separate at least two sections of the tray, a perforation similar to perforation 34 may be provided, which is sized to facilitate tearing. An example of such a perforation includes a ⅛ inch by ⅛ inch perforation. In another embodiment, however, where a portion of a tray is intended to be folded and not torn, a perforation may be provided that is sized to facilitate product retention and package integrity.

Further the skilled artisan will appreciate that once individual compartments are formed in the trays of the present disclosure, the individual compartments can remain connected or may be separated. For example, once formed in tray 50, separate compartments 52, 54 can remain attached to each other, or may be separated from each other. The compartments 52, 54 may be separated from each other along perforation 34 by cutting, tearing, a tear strip, tear tape, or other known ways of separating materials.

As mentioned above, any number of perforations/scores like perforation line 34 may be provided such that when blank 10 is folded into a tray, any number of separate and distinct compartments may be formed. In this manner, tray 50 may include any number of individual compartments. The individual compartments may be equally sized compartments, or may be different sized compartments. In the same manner, each, or every, compartment formed in tray 50 may be divided into 2 or more sub-compartments. For example, tray 50 of FIG. 3 includes first compartment 52 and second compartment 54. One or both of first and second compartments 52, 54 may be divided into two or more sub-compartments.

Figure 4:
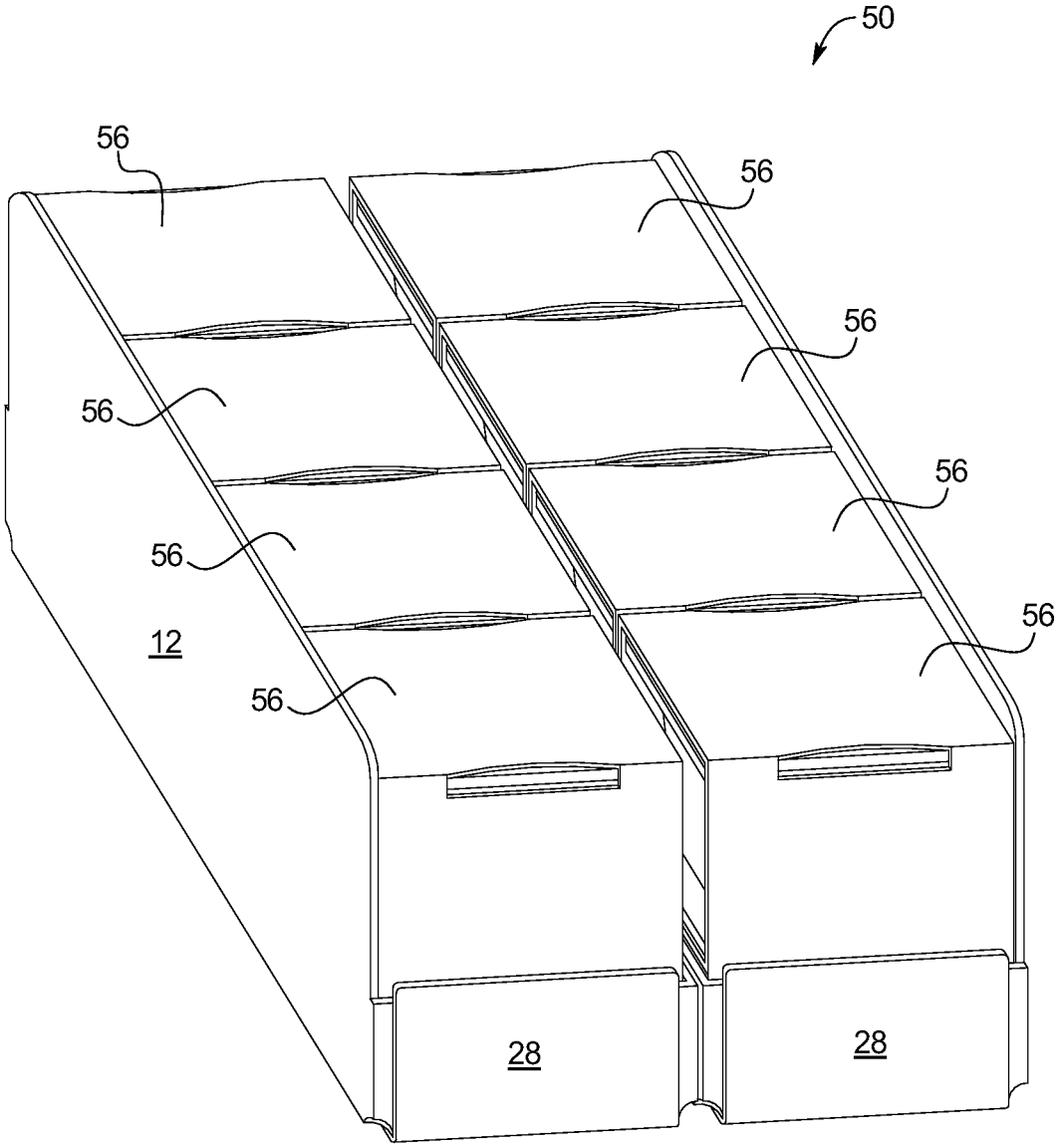
FIG. 4 illustrates a perspective view of a package containing secondary packages in accordance with an embodiment of the present disclosure.

Providing separate compartments 52, 54 and sub-compartments (not shown) will allow different types and amounts of products to be housed in tray 50. For example, for consumable products of larger size, first compartment 52 may include one or more of the product, while second compartment 54 includes one or more of the product, or even one or more of a different product. FIG. 4 illustrates an embodiment wherein tray 50 includes a plurality of secondary packages 56, which house a consumable product.

In another embodiment, the trays of the present disclosure may be used to provide individual meal servings. For example, tray 50 of FIG. 3 may be configured to contain two individual meal servings for two children, one in first compartment 52 and one in second compartment 54. In this manner, tray 50 can feed two children, each of which will have their own individual compartment of food. As described above, individual compartments 52, 54 may be sub-divided into sub-compartments to provide more than two children with a meal. The skilled artisan will also appreciate that prior to separation of first compartment 52 and second compartment 54, tray 50 may also be stored, frozen, refrigerated, heated or the product therein consumed.

Figure 5:
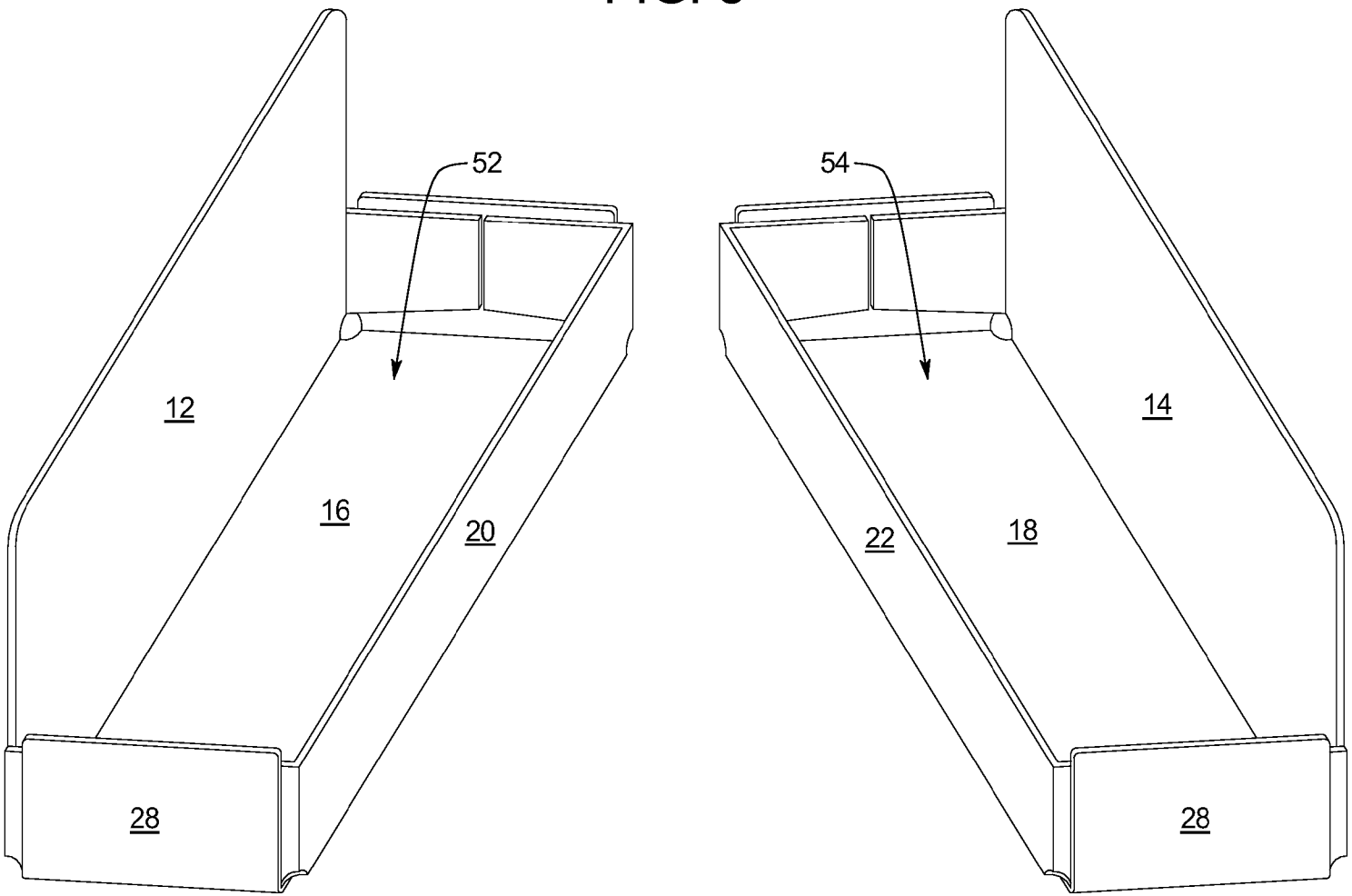
FIG. 5 illustrates a perspective view of a package separated into two compartments in accordance with an embodiment of the present disclosure.

For example, first compartment 52 may be separated from second compartment 54 to provide two, separate and distinct compartments, as is shown in FIG. 5. By separating the first and second compartments 52, 54, the products of first compartment 52 may be consumed, while the products of compartment 54 are stored in a shelf, refrigerated, or frozen. Alternatively, the products of first compartment 52 may be refrigerated while the products of second compartment 54 are heated. The skilled artisan will appreciate that any combination of storage, freezing, refrigerating, heating, or consuming may be used with first and second compartments 52, 54.

Figure 6:
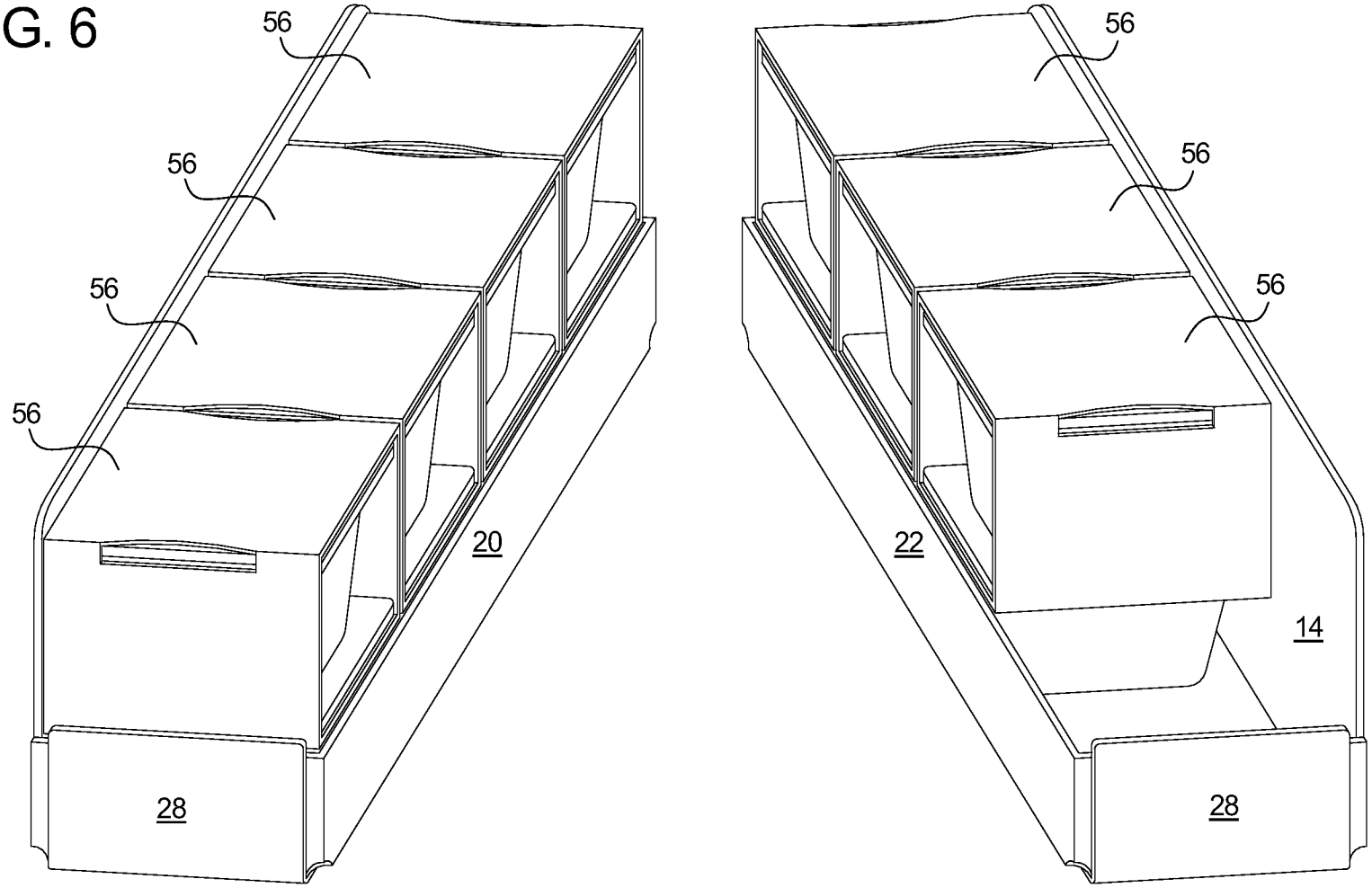
FIG. 6 illustrates a perspective view of a package separated into two compartments and containing secondary packages in accordance with an embodiment of the present disclosure.

Another advantage of separating first and second compartments 52, 54 is enhanced marketability. In an embodiment of the present disclosure, and as shown in FIG. 6, first and second compartments 52, 54 include secondary containers 56, which may contain, for example, edible food products. As is shown in FIG. 6, a sufficient amount of the front of secondary containers 56 is visible from a front view of first and second compartments 52, 54. Providing first and second compartments 52, 54 that allow for visibility of, for example, secondary containers 56 provides the advantage of improved marketability. In this regard, a retailer may remove lid 42 from tray 50, separate first compartment 52 from second compartment 54 and place compartments 52, 54 on a retail shelf to display secondary packages 56 for sale. In this manner, the trays of the present disclosure provide for a quick and easy manner in which to enhance the marketability of a product.

Figure 7:
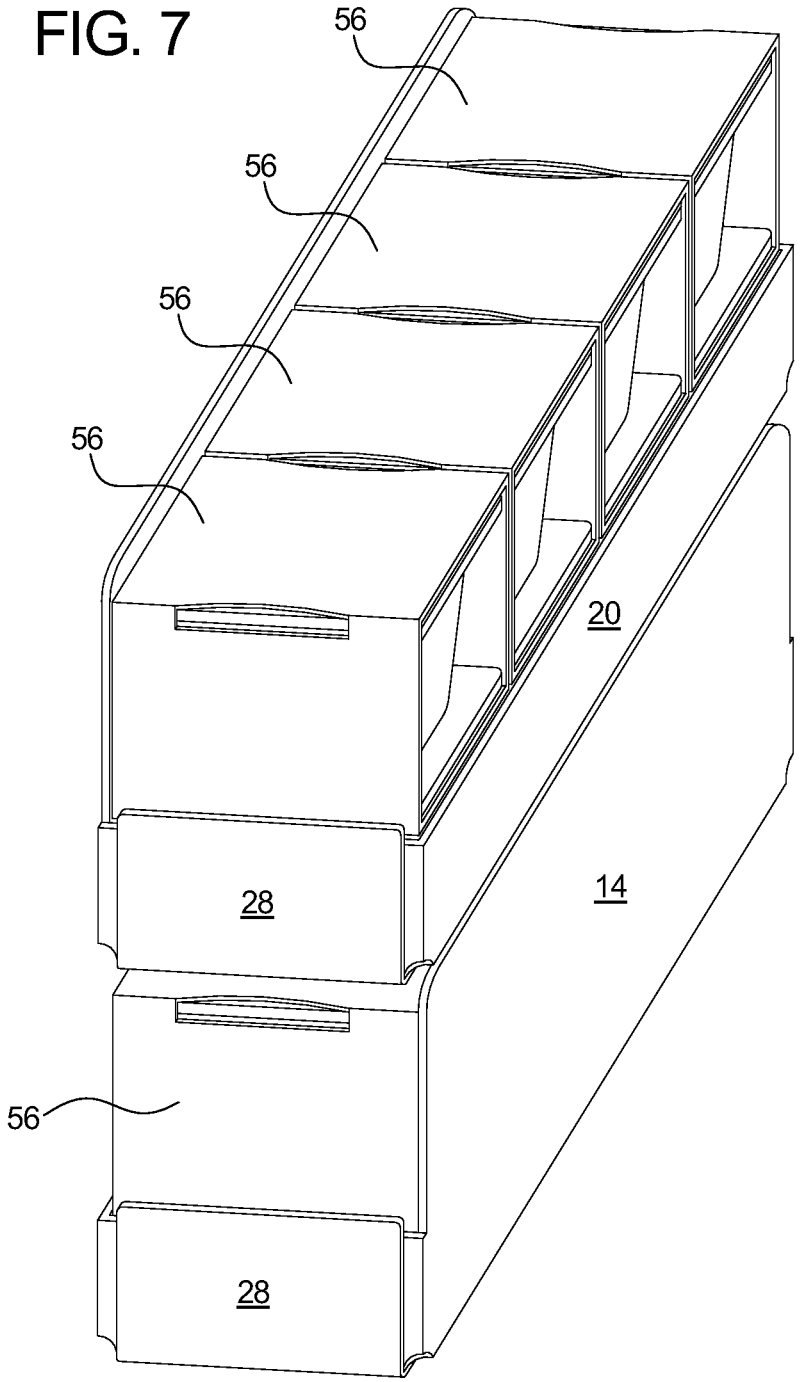
FIG. 7 illustrates a perspective view of a package separated into two compartments and containing secondary packages in accordance with an embodiment of the present disclosure.

To further enhance marketability of the products, first and second compartments 52, 54 may be stacked one on top of each other so that a greater amount of product may be stacked on a retail shelf, as is shown in FIG. 7. In this manner, packages in accordance with the present disclosure also provide the benefits of reduced storage space, ease of storage, and enhanced marketability.

Marketability of the present packages may further be enhanced by the presence of an indicia provided on an exterior and/or interior of the trays of the present disclosure, or an indicia provided on an exterior of secondary packages contained in the trays. The indicia may include, for example, logos, advertisements, branding information, nutritional information, product information, manufacturer information, or the like, or combinations thereof. For example, trays can include branding information at any exterior or interior surface thereon. The indicia may also be provided in a number of ways. For example, in an embodiment, the indicia may be printed on a pressure sensitive material (e.g., sticker), printed directly on the trays, molded into the trays, etc. In a different embodiment, the trays may be surrounded by a layer of material printed with indicia such as a shrink wrap material. The skilled artisan will appreciate that the types or methods of branding packages or secondary packages are not limited by those examples disclosed herein and that the indicia or method of applying same may include any types or methods of application known in the art.

In an embodiment, methods for making trays of the present disclosure are provided. For example, as shown in FIG. 8A, blank 10 is provided with a perforation 34, which is "broken" or "creased" to begin the folding process. As blank 10 is folded along perforation 34, blank 10 also folds at the interface of middle sections 16, 18 and inner sections 20, 22, respectively, as shown in FIG. 8B. Blank 10 continues to fold along perforation 34 until inner sections 20, 22 form a substantially vertical interior wall of the tray. The inner wall includes inner sections 20, 22, which are substantially vertical, adjacent to each other and substantially overlapping, as shown in FIG. 8C. At this stage in the process, the remainder of blank 10 is still substantially horizontal. If the tray is intended to house secondary packages, the secondary package may be loaded onto the tray at this time, as is shown in FIG. 8D. The skilled artisan will appreciate, however, that the contents of the trays need not be loaded onto the tray at this time and may be loaded into the tray after completing formation of the tray, or at any suitable time during the making of the trays.

After formation of the inner wall, side walls of the tray are formed by folding first and second outer sections 12, 14 along fold lines intermediate first and second outer sections 12, 14 and first and second middle sections 16, 18, respectively. At this stage in the forming of the tray, end panels 28 have not yet been folded, as is shown in FIG. 8E.

To form front and back walls of the tray, end panels 28 are folded and secured to each other. Although the same process may be used to form both the front and the back walls of the tray, the process will be described in terms of the front wall, which is visible in FIGS. 8E and 8F. To form the front wall, end panels 28 of first outer section 12 and first inner section 20 are folded toward each other. Similarly, end panels 28 of second outer section 14 and second inner section 22 are folded toward each other. Next, end panel 28 of first middle section 16 is folded upward and attached to end panels 28 of first outer section 12 and first inner section 20. Similarly, end panel 28 of second middle section 18 is folded upward and attached to end panels 28 of second outer section 14 and first inner section 22. Any end panel 28 may be attached to any other end panel 28 by any attachment means known in the art and including, for example, glue, tape, chemical adhesives, staples, epoxy, etc. In an embodiment, end panels 28 of first outer section 12 and first inner section 20 are attached to end panel 28 of first middle section 16.

As shown in FIG. 8G, once tray 50 has been fully formed, a lid or shroud 42 may be placed over top of the open chamber of tray 50 to prevent the products housed therein from falling out, and to protect the product during shipment, storage, etc. As discussed above, the lid or shroud 42 may be formed from the same material as the tray and may be adhered to the tray, or may simply include a shrink-wrap or plastic cover that encases the tray. In this manner, lid 42 may be manufactured from plastic, cardboard, fiberboard, paperboard, jute, styrofoam, metals, or combinations thereof. In an embodiment, lid 42 is manufactured from corrugated cardboard.

In an alternative embodiment, product may be loaded into blank 10 when blank 10 is configured as shown in FIG. 2. In this embodiment, inner sections 20, 22 do not form an inner wall in tray 40. Rather, a bottom wall is formed from middle sections 16, 18 and inner sections 20, 22, and product may be loaded onto the bottom wall. When outer sections 12, 14 and end panels 28 are folded upward, a lid 42 may be placed over same to prevent the products housed therein from falling out, and to protect the product during shipment, storage, etc. A lid in this embodiment may be the same as lid 42, but slightly longer to account for the substantially horizontal inner sections 20, 22, instead of the substantially vertical inner sections 20, 22.

In the embodiment of FIG. 2, the consumer or retailer may remove lid 42 from tray 40, separate tray 40 along perforation 34, fold end panels 28 of first inner section 20 toward first outer section 12, fold end panels 28 of second inner section 22 toward second outer section 14, and attach them to the other end panels. In this manner, the consumer or retailer is allowed to decide whether it is best to provide a one chamber open tray (as in FIG. 2) or to provide a tray having an inner wall and separable chambers (as in FIG. 3).

Methods for displaying products contained within trays of the present disclosure are also provided. In a first embodiment, one, integral tray is provided for display. The method includes providing a tray housing a consumable product, the tray having first and second opposing side walls, a front wall with a plurality of panels, a back wall with a plurality of panels, and a bottom wall comprising one of a perforation and a score that is configured to separate the tray into two individual sections. The method further includes placing the tray on a retail shelf.

In another embodiment, a method for displaying a consumable product is provided. The method includes providing a tray housing a consumable product, the tray having a first compartment having an exterior side wall, an interior side wall, a front wall, a back wall, and a bottom wall, and a second compartment having an exterior side wall, an interior side wall, a front wall, a back wall, and a bottom wall. The interior wall of the first compartment and the interior wall of the second compartment are joined by one of a perforation and a score. The method further includes placing the tray on a retail shelf.

In still yet anther embodiment, a method for displaying a consumable product is provided. The method includes providing a tray housing a consumable product, the tray having a chamber defined by first and second opposing side walls, a front wall, a back wall, and a bottom wall. A portion of the bottom wall is folded into the chamber to form at least two compartments of the tray. The method further includes placing the tray on a retail shelf.

In another embodiment, a method for displaying a consumable product is provided. The method includes providing a tray housing a consumable product, the tray including first and second opposing side walls, a front wall, a back wall, a bottom wall, and an interior wall that divides the tray into at least two separate compartments. The interior wall includes first and second adjacent panels joined by one of a perforation and a score. The method further includes placing the tray on a retail shelf.

In a second embodiment, the first and second compartments of the tray are separated from each other and provided for display. For example, the method includes providing a tray housing a consumable product, the tray having first and second opposing side walls, a front wall comprising a plurality of panels, a back wall comprising a plurality of panels, and a bottom wall including one of a perforation and a score that is configured to separate the tray into two individual sections. The method further includes tearing the tray along the one of a perforation and a score to separate the tray into the two individual sections, and placing at least one of the two individual sections on a retail shelf.

In yet another embodiment, a method for displaying a consumable product is provided. The method includes providing a tray housing a consumable product, the tray having a first compartment having an exterior side wall, an interior side wall, a front wall, a back wall, and a bottom wall, and a second compartment having an exterior side wall, an interior side wall, a front wall, a back wall, and a bottom wall. The interior wall of the first compartment and the interior wall of the second compartment are joined by one of a perforation and a score. The method further includes tearing the tray along the one of a perforation and a score to separate the first and second compartments, and placing at least one of the first and second compartments on a retail shelf.

In another embodiment, a method for displaying a consumable product is provided. The method includes providing a tray housing a consumable product, the tray having a chamber defined by first and second opposing side walls, a front wall, a back wall, and a bottom wall. A portion of the bottom wall is folded into the chamber to form at least two compartments of the tray. The method further includes separating the at least two compartments of the tray, and placing at least one of the at least two compartments on a retail shelf.

In yet another embodiment, a method for displaying a consumable product is provided. The method includes providing a tray housing a consumable product, the tray having first and second opposing side walls, a front wall, a back wall, a bottom wall, and an interior wall that divides the tray into at least two separate compartments. The interior wall includes first and second adjacent panels joined by one of a perforation and a score. The method further includes tearing the tray along the one of a perforation and a score to separate the tray into the at least two separate compartments, and placing at least one of the at least two compartments on a retail shelf.

The skilled artisan will appreciate that the above described methods for displaying products may also apply to methods for storing products, refrigerating products, freezing products, heating products, etc. Methods for serving meals (e.g., to children) are also supported by the present disclosure.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A package blank formed of a sheet of material and formable into a tray, comprising:

a first inner section and a second inner section positioned adjacent to one another, each of the first inner section and the second inner section having a width, a first outer section and a second outer section, each of the first outer section and the second outer section having a width, and a first middle section and a second middle section, each of the first middle section and the second middle section having a width, wherein the first inner section and the second inner section are delineated from one another by a perforation, wherein the first middle section is located between the first outer section and the first inner section, and the second middle section is located between the second outer section and the second inner section, wherein each of the first inner section, the second inner section, the first middle section, the second middle section, the first outer section, and the second outer section have a first end section extending from one end thereof and a second end section extending from an opposing end thereof, each of the first end sections and the second end sections having a width, wherein the width of the first end section and the width of the second end section of the first inner section is less than the width of the first inner section and the width of the first end section and the width of the second end section of the second inner section is less than the width of the second inner section, and wherein the first end section of the first inner section is delineated from the first end section of the of the second inner section by a perforation and the second end section of the first inner section is delineated from the second end section of the of the second inner section by a perforation, wherein the blank is foldable in one way to form a chamber defined by first and second side walls being the first and the second outer sections, a front wall, a back wall, and a bottom wall wherein the bottom wall comprises the first inner section, the second inner section, the first middle section, and the second middle section in a flat state, the front wall and the back wall are formed by the first and the second end sections of the first and second inner section, the first and second middle sections, and the first and second outer sections with the first ends sections of the first and second inner sections extending from one another and the second end sections of the first and second inner sections extending from one another, wherein the blank is foldable in another way to form the chamber into at least two compartments by folding the first and second inner sections into the chamber to define a separating wall and detaching the first end sections of the first and second inner sections from one another and detaching the second end sections of the first and second inner sections from one another.

2. The package blank according to claim 1, wherein the first and second end sections of the first and second inner sections have a length, and wherein the length of the first end section of the first inner section is less than the length of the first end section of the second inner section, and wherein the second end section of the first inner section is less than the length of the second end section of the second inner section.

3. The package blank according to claim 1, wherein the first and second end sections each comprise a panel; wherein the outer sections, inner sections and middle sections are joined to their respective end panels by one of a score and a perforation; wherein the end panels of the first and second middle sections are substantially as wide as the first and second middle sections; and wherein the end panels of the first and second outer sections are located substantially adjacent to the end panels of the first and second middle sections.

4. The package blank according to claim 1, wherein the blank is made of a material selected from the group consisting of plastic, cardboard, fiberboard, paperboard, jute, styrofoam, metals, and combinations thereof.

5. A tray comprising:

a chamber defined by first and second side walls being first and second outer sections, a front wall, a back wall, and a bottom wall, wherein the bottom wall comprises first and second inner sections joined by a perforation and first and second middle sections, the first middle section located between the first outer section and the first inner section, and the second middle section located between the second outer section and the second inner section, wherein the first and second outer sections and the first and second middle sections, respectively, are joined by one of a score and a perforation; and wherein the first and second middle sections and the first and second inner sections, respectively, are joined by one of a score and a perforation, wherein the first and second outer sections, the first and second inner sections and the first and second middle sections each comprise first and second end sections and the first and second end sections each comprise an end panel, wherein the front and back walls are formed by the end panels of the first and second end sections, wherein end panels of the first and second inner sections are not connected to the end panels of the first and second middle sections when the bottom lays flat, wherein the perforation delimiting the first and second inner sections from each other and the perforations and/or scores delimiting the inner sections from the first and second middle sections, respectively, is configured to (i) allow the bottom wall to lay flat in a first embodiment, and (ii) allow a portion of the bottom wall to be folded into the chamber to form at least two compartments in a second embodiment, wherein the separating wall is configured to be tearable along the perforation separating the inner sections to separate the tray into two discrete sections.

6. The tray according to claim 5, wherein the front wall comprises at least two panels in both the first and second embodiments, wherein the panels extend from the bottom wall.

7. The tray according to claim 5, wherein the panels extend from the bottom wall.

8. The tray according to claim 5, wherein the tray is formed from one piece of material.

9. The tray according to claim 5, wherein the material is selected from the group consisting of plastic, cardboard, fiberboard, paperboard, jute, styrofoam, metals, and combinations thereof.

10. The tray according to claim 5, wherein the material is corrugated cardboard.

11. The tray according to claim 5, wherein the at least two components are mirror images of each other along the one of a perforation and a score.

12. A method for making a tray, the method comprising the steps of:

providing a blank comprising:

first and second outer sections, first and second inner sections joined by one of a perforation and a score, and first and second middle sections, the first middle section located between the first outer section and the first inner section, and the second middle section located between the second outer section and the second inner section, wherein the outer sections, inner sections and middle sections each comprise first and second end sections;

wherein the first and second end sections each comprise an end panel;

wherein the outer sections, inner sections and middle sections are joined to their respective end panels by one of a score and a perforation, wherein the end panels of the first and second middle sections are substantially as wide as the first and second middle sections;

wherein the end panels of the first and second outer sections are located substantially adjacent to the end panels of the first and second middle sections and wherein the end panels of the first and second inner sections are located substantially adjacent to each other, wherein the end panels of the first and second inner sections are not connected to the end panels of the first and second middle sections when the bottom lays flat;

folding the blank along the one of a perforation and score;

folding the blank along lines dividing the first and second middle sections from the first and second inner sections, respectively, so that the inner sections form a vertical interior wall of the tray;

folding the blank along lines dividing the first and second middle sections from the first and second outer sections, respectively, to form a tray, wherein the blank further comprises first and second ends, each of the first and second ends comprising a plurality of panels;

tearing the tray along the one of a perforation and a score to separate the tray into the two individual sections; and placing at least one of the two individual sections on a retail shelf.

13. The method according to claim 12 further comprising folding the plurality of panels of the first end to form a front wall, and folding the plurality of panels of the second end to form a back wall.

14. The method according to claim 12, wherein the plurality of panels of the second end are adhered to each other to form the back wall.

15. The method according to claim 12 further comprising placing secondary packages onto the blank after folding the blank along lines dividing the first and second middle sections from the first and second inner sections, respectively.

16. The method according to claim 12 further comprising placing consumable products into the tray after folding the blank along lines dividing the first and second middle sections from the first and second outer sections, respectively.

17. The method according to claim 12 further comprising placing a shroud over the tray.

* * * * *